United States Patent [19]

Dunn et al.

[11] Patent Number: 4,874,575

[45] Date of Patent: Oct. 17, 1989

[54] MULTIPLE DISCHARGE CYLINDRICAL PUMP COLLECTOR

[75] Inventors: Charlton Dunn, Calabasas; Robert J. Bremner, Woodland Hills; Sen Y. Meng, Reseda, all of Calif.

[73] Assignee: Rockwell International Corporation, El Segundo, Calif.

[21] Appl. No.: 246,888

[22] Filed: Sep. 15, 1988

Related U.S. Application Data

[63] Continuation of Ser. No. 69,994, Jul. 6, 1987, abandoned.

[51] Int. Cl.[4] ..... G21D 1/04

[52] U.S. Cl. ..... 376/404; 415/206; 415/913

[58] Field of Search ..... 376/404; 415/206, DIG. 7

[56] References Cited

U.S. PATENT DOCUMENTS

| | | | |
|---|---|---|---|
| 753,154 | 2/1904 | Look . | |
| 815,674 | 3/1900 | Bent . | |
| 1,662,249 | 3/1928 | Jennings . | |
| 2,625,110 | 1/1953 | Haentjens et al. | 103/102 |
| 2,887,958 | 5/1959 | Davidson | 103/103 |
| 3,173,241 | 3/1965 | Birmann | 60/13 |
| 3,355,097 | 11/1987 | Horschuch | 415/DIG. 7 |
| 3,816,020 | 6/1974 | Ogles | 415/111 |
| 3,865,506 | 2/1975 | Gerlach | 415/213 |
| 3,871,789 | 3/1975 | Lameris | 415/112 |
| 3,910,714 | 10/1975 | Allen et al. | 415/53 |
| 3,927,521 | 12/1975 | Hugoson et al. | 60/39.31 |
| 4,063,849 | 12/1977 | Modianos | 415/210 |
| 4,087,197 | 5/1978 | Haugen | 415/DIG. 7 |
| 4,219,385 | 8/1980 | Guidez et al. | 376/404 |

*Primary Examiner*—Deborah L. Kyle
*Assistant Examiner*—Richard W. Wendtland
*Attorney, Agent, or Firm*—H. Fredrick Hamann; Harry B. Field; David C. Faulkner

[57] ABSTRACT

A space-saving discharge collector 40 for the rotary pump 28 of a pool-type nuclear reactor 10. An annular collector 50 is located radially outboard for an impeller 44. The annular collector 50 as a closed outer periphery 52 for collecting the fluid from the impeller 44 and producing a uniform circumferential flow of the fluid. Turning means comprising a plurality of individual passageways 54 are located in an axial position relative to the annular collector 50 for receiving the fluid from the annular collector 50 and turning it into a substantially axial direction.

2 Claims, 4 Drawing Sheets

MULTIPLE DISCHARGE CYLINDRICAL PUMP COLLECTOR

STATEMENT OF GOVERNMENT INTEREST

The Government has rights in this invention pursuant to Contract (or Grant) No. DE-AT03-83SF11901 awarded by the U.S. Department of Energy.

This is a continuation of co-pending application Ser. No. 069,994 filed on July 6, 1987, now abandoned.

BACKGROUND OF THE INVENTION

1. Field of the Invention

This invention relates to discharge collectors for pumps and more particularly to a discharge collector for a rotary pump of a pool-type nuclear reactor.

2. Description of the Prior Art

Nuclear power facilities for the generation of electrical power include a sealed containment vessel in which is located the reactor core. In a loop reactor only the reactor core and portions of the core assembly transfer mechanism are located within the vessel. The pumps and heat exchangers are located externally of the vessel. Therefore, the size and geometry of the pumps are not critical. However, in a pool-type nuclear reactor in addition to the nuclear reactor core, various auxiliary equipment, such as intermediate heat exchangers, pumps and the like, are all immersed in a pool of liquid metal coolant within the containment vessel. The pump envelope is basically determined by the outer diameter of the collector. Therefore, since the envelope diameter of the components within the containment vessel establish the containment vessel diameter, the pump collector size is a contributing element. Conventional discharge collectors such as the 4-tongue, 4-discharge volute distributes the flow radially with the four outward spiraling volute passages nested to each other. The spiral configuration of the collector (volute) creates a large envelope diameter. Multiple volute tongues (and corresponding discharges) help reduce the envelope diameter.

In the device disclosed in U.S. Pat. No. 3,910,714 entitled, "Liquid Metal Pump for Nuclear Reactors" issued to H. G. Allen et al, fluid leaves the impeller of the rotary pump and is directed through diffuser passages which turn the tangential (i.e. circumferential) flow to a radial flow. The fluid then flows through straightening vanes which direct the flow radially inward and through a discharge adapter in an axial direction. The relatively long length and number of turns in the fluid path of the device reduces the efficiency.

OBJECTS AND SUMMARY OF THE INVENTION

A principal object of the invention, therefore, is to provide a discharge collector which is compact and has a lower ratio of collector envelope diameter to collector inlet diameter than conventional discharge collectors.

Another object of the invention is to provide a discharge collector with multiple discharges in the axial direction.

A further object of the invention is to provide a discharge collector with low loss from inlet to discharge.

Other objects, advantages and novel features of the present invention will become apparent from the following detailed description of the invention when considered in conjunction with the accompanying drawing.

SUMMARY OF THE INVENTION

In its broadest aspects, the discharge collector or system of the present invention comprises the combination of an annular collector and turning means. This system, effectively collects and discharges the coolant from the impeller of a rotary pump in a pool-type nuclear reactor. The annular collector is located radially outboard from the impeller and has a closed outer periphery for collecting the fluid from the impeller and producing a uniform circumferential flow of the fluid. The turning means comprises a plurality of individual passageways located in an axial position relative to the annular collector for receiving the fluid from the annular collector and turning it into a substantially axial direction.

In the preferred embodiment the coolant flow is directed from the impeller and through a plurality of diffuser vanes prior to being directed to the annular collector. The diffuser acts to significantly reduce the tangential component of the fluid velocity.

BRIEF DESCRIPTION OF THE DRAWINGS

The same elements or parts throughout the figures are designated by the same reference characters.

DETAILED DESCRIPTION OF THE INVENTION

Figure 1:
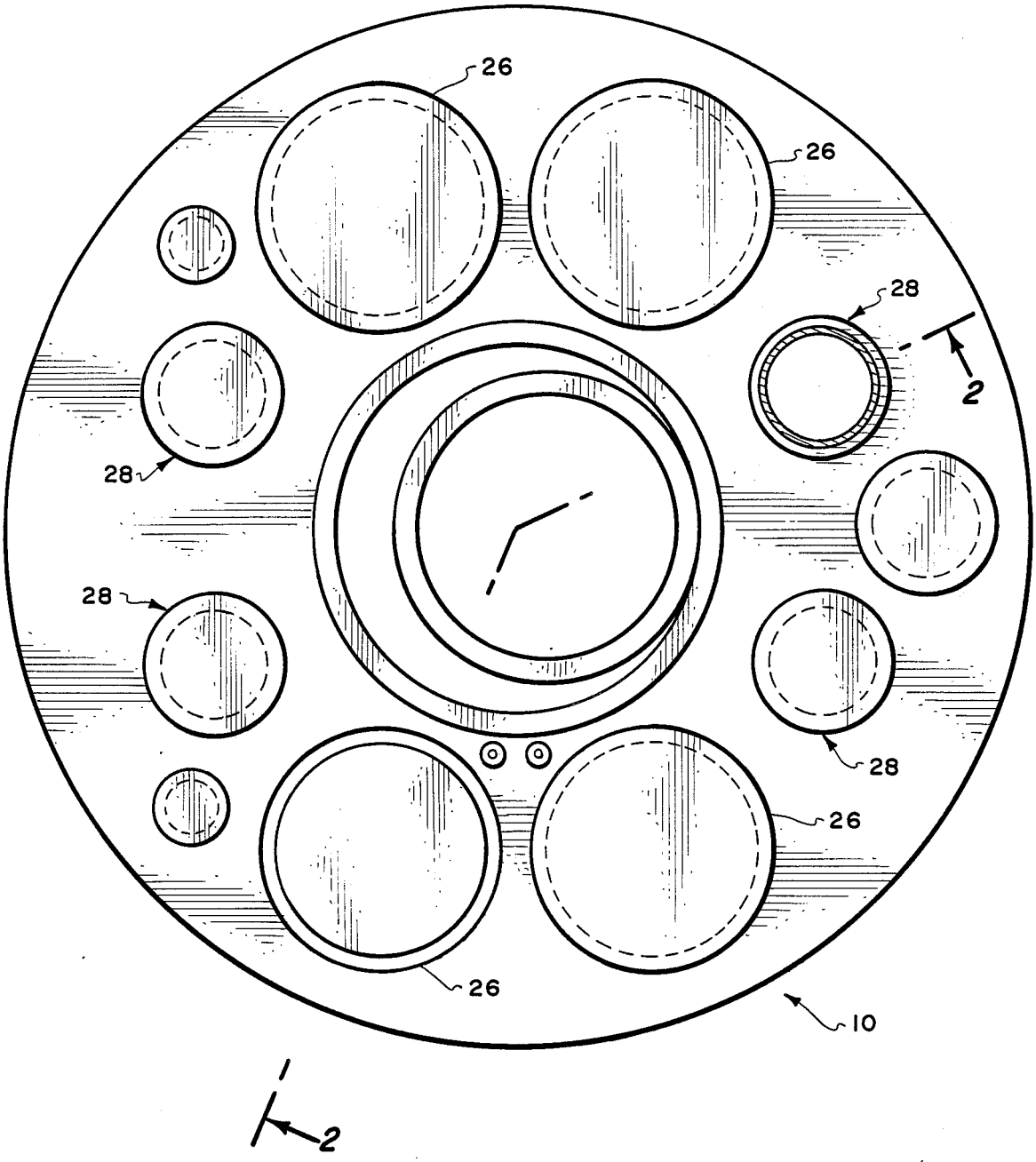
FIG. 1 is a plan view of a pool-type nuclear reactor.

Turning now to the drawings wherein like components and features are designated by like reference numerals throughout the various figures, attention is directed to FIG. 1 which illustrates a plan view of a pool-type, liquid-metal cooled nuclear reactor generally designated by the reference numeral 10. As shown in the cross-sectional elevation view of FIG. 2, the reactor includes a containment vessel 12 containing a core barrel 14. Containment vessel 12 is divided into two compartments, 16 and 18, by a barrier generally referred to as a redan 20. Each of compartments 16 and 18 contain a body of liquid metal coolant which typically will be sodium, potassium or a mixture thereof.

Figure 2:
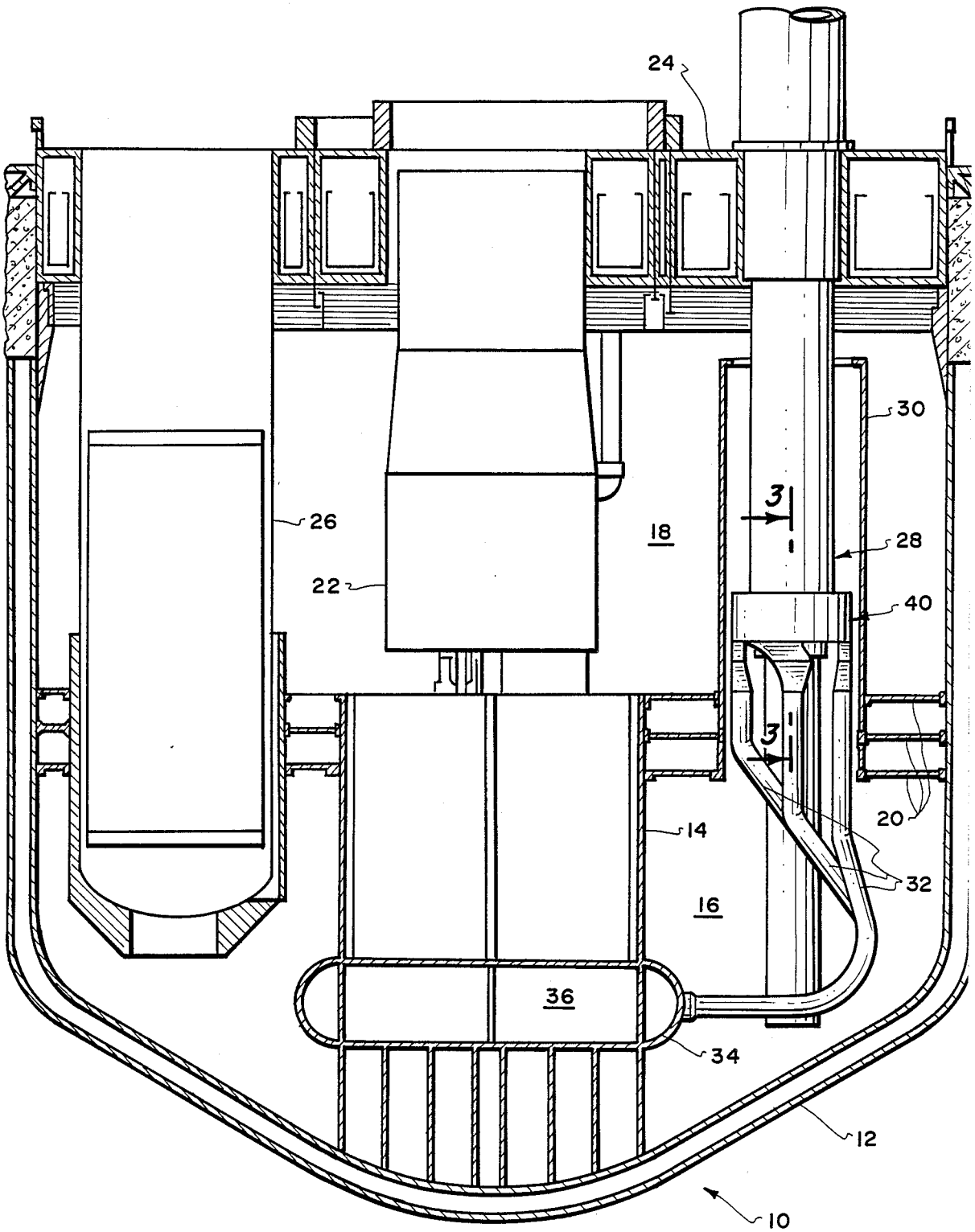
FIG. 2 is a schematic cross-sectional elevation view of the nuclear reactor taken along cutting plane 2—2 of FIG. 1 and showing the discharge collector of the present invention.

A control rod and instrumentation island 22 is suspended from a deck 24 located at the top end of the containment vessel. As shown in the plan view of FIG. 1, four heat exchangers 26 are utilized as are four pumps, each generally designated as 28. As previously noted and as can be seen in FIGS. 1 and 2, space is at a premium. Savings of one inch (approximately 1%) in pump diameter can reduce costs of the liquid-metal cooled nuclear reactor by approximately $200,000 due to reduction in the containment vessel diameter.

Each pump 28 fits within a pump well 30. Discharge pipes 32 lead to a coolant inlet manifold 34 for the inlet plenum 36 to the reactor core. The liquid metal coolant flows from plenum 36 through the reactor core within core barrel 14 where the coolant absorbs heat before entering (the upper "hot" pool) compartment 18. From compartment 18 the coolant flows through an intermediate heat exchanger 26 and then back to (the lower "cold" pool) compartment 16. It will be appreciated that the reactor also includes numerous other components and assemblies some of which also will be located within the sodium pool. For purposes of understanding the present invention, however, it is only necessary to understand the requirement of a space-saving discharge collector, generally designated 40.

Figure 3:
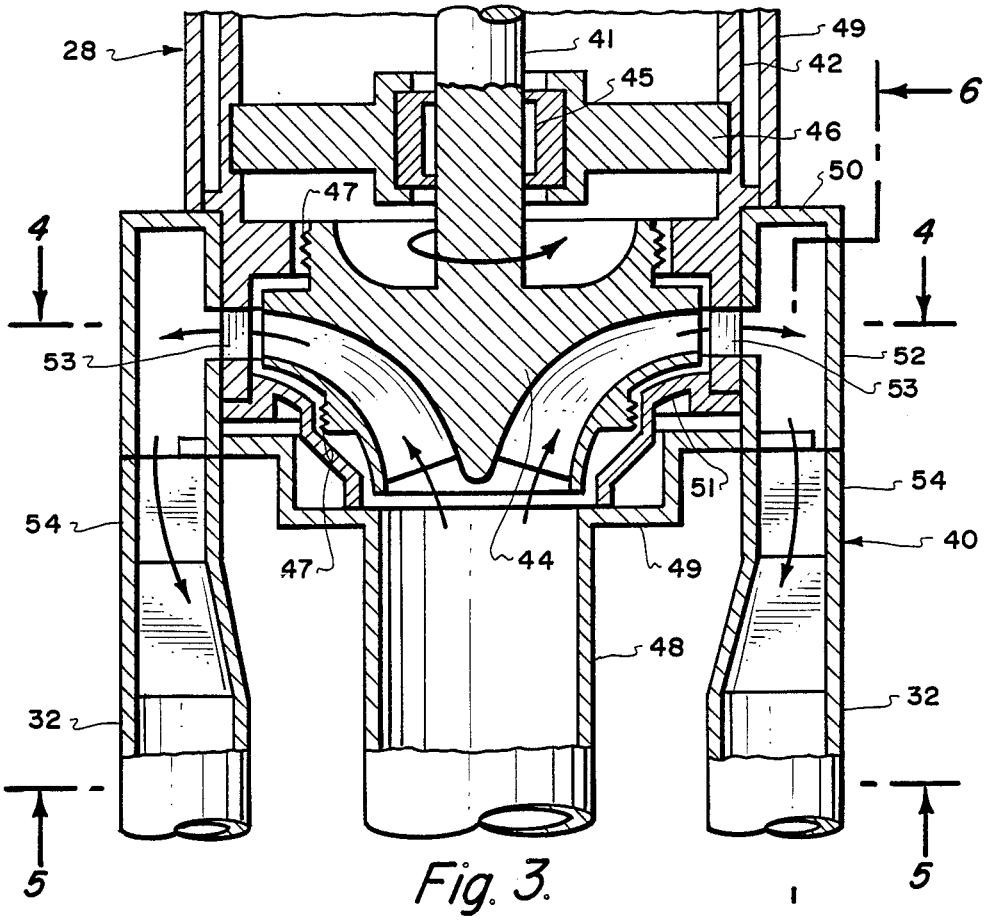
FIG. 3 is an enlarged cross-sectional elevation view in partial cross-section of the rotary pump including the discharge collector taken along line 3—3 of FIG. 2.
Figure 4:
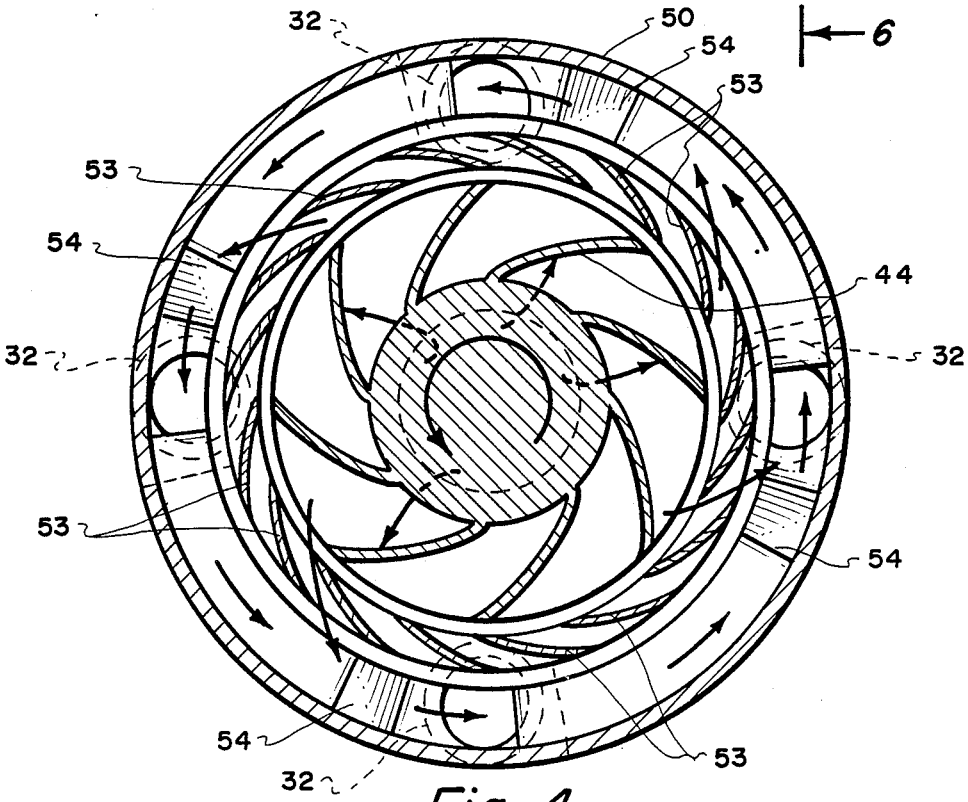
FIG. 4 is a cross-sectional view of the rotary pump including the discharge collector taken along cutting plane 4—4 of FIG. 3.
Figure 5:
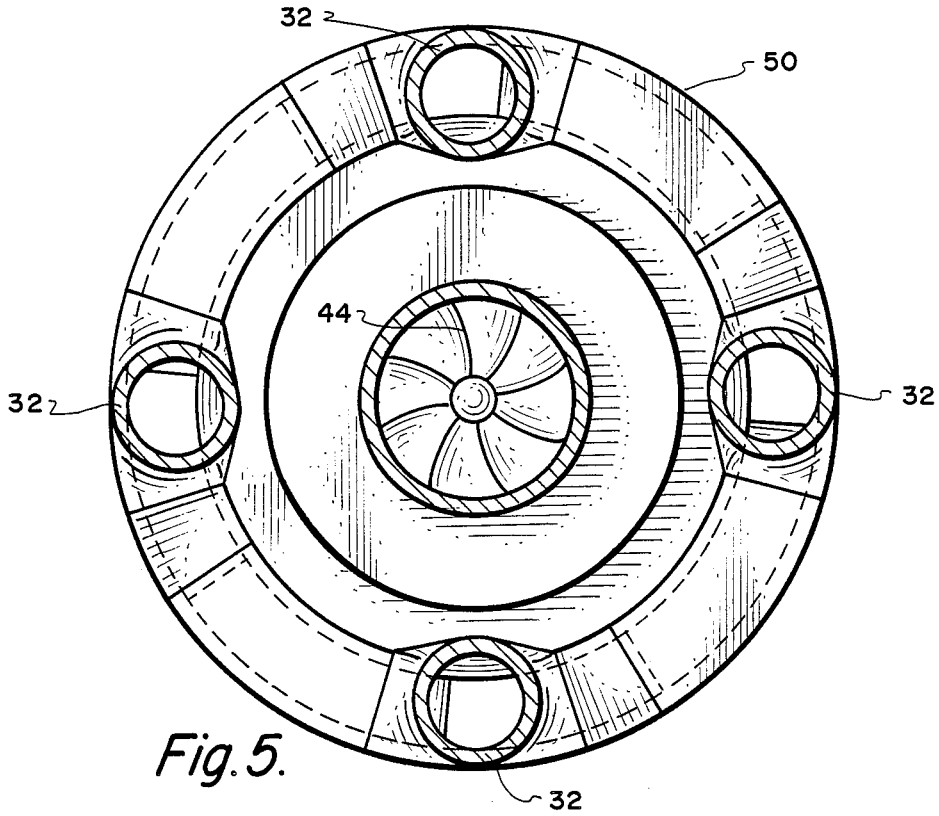
FIG. 5 is a cross-sectional view of the rotary pump and discharge collector taken along cutting plane 5—5 of FIG. 3.
Figure 6:
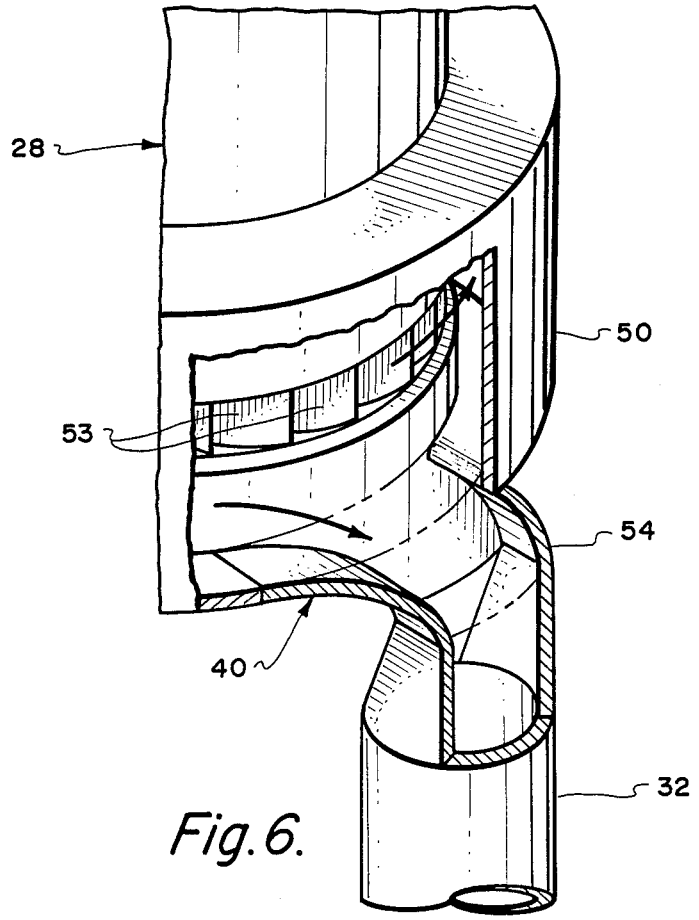
FIG. 6 is an enlarged, partially broken away perspective view of the rotary pump and discharge collector taken along line 6—6 of FIG. 3.

Referring now to FIG. 3, a rotatable shaft 41 of pump 28 extends through the bottom end portion of a pump internal support cylinder 42. The shaft 41 terminates with an impeller 44. A shaft bearing 45 is located between a bearing support housing 46 and the shaft 41. Upper and lower rotary seals 47 are formed on the impeller 44 and seal to the internal support cylinder 42 and to a lower impeller housing 51. A fluid inlet pipe 48 is attached to or is integral with the pump casing 49 which is also attached or integral with the pump discharge and collector system 40. The pump discharge and collector system 40 provides a means for collecting and discharging coolant from the impeller 44. It includes an annular collector 50 which is located radially outboard from the impeller 44. Annular collector 50 has a closed outer periphery 52. As shown most clearly in FIG. 4, diffuser vanes 53 are located between the impeller 44 and the annular collector 50. The pump discharge and collector system 40 also includes turning means which comprises a plurality of individual passageways or ducts 54 located in an axially downwardly direction from the annular collector 50 for receiving the fluid from the annular collector 50 and turning it into a substantially axial direction, and thence into the discharge pipes 32. The radial distribution of the four discharge pipes 32 of the preferred embodiment is illustrated in FIG. 5. Passageways 54 are most clearly seen with reference to FIG. 6.

During operation, fluid from the cold pool 16 of liquid metal coolant fluid is introduced through the inlet pipe 48 of each rotary pump 28. The impeller 44 produces a highly circumferential flow of fluid to the diffuser 53 which significantly reduces the tangential component of the fluid velocity. Fluid then flows into the annular collector 50 where it becomes circumferential.

The fluid is then "ducted" from the annular collector 50 by turning means or ducts 54. The ducts 54 turn the fluid into a substantially axial direction. The discharge is then directed into the discharge pipes 32 and thence into the coolant inlet manifold 34 for the reactor core.

The space-saving discharge and collector system 40 is approximately 20% smaller in diameter for a four-pipe discharge system compared to a four-discharge, four-tongue volute. This provides a cost savings of approximately $4 Million in the cost of the liquid-metal cooled nuclear reactor due to reduction in the containment vessel diameter.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. In an improved method for circulating fluid coolant through a reactor core of a pool-type nuclear reactor having a sealed containment vessel containing a reactor core submersed in a body of liquid coolant, said method for circulating coolant including utilization of a rotary pump including an impeller for producing a highly circumferential flow of cooling fluid and a method for collecting and discharging coolant fluid, the improvement to the method of collecting and discharging coolant fluid including the steps of:

(1) producing a substantially uniform circumferential flow of the fluid by directing said flow through a plurality of diffuser vanes and into an annular collector located radially outboard from said impeller, said annular collector having an entirely closed outer periphery; and (2) turning said flow of cooling fluid into a substantially axially direction while maintaining a substantially constant average flow velocity by directing the coolant flow from said annular collector into a plurality of individual passageways located in an axial position relative to said annular collector.

2. A pool-type nuclear reactor having a sealed containment vessel including a reactor core further including:

(a) A rotary pump system including a pump casing for circulating a liquid metal coolant through the reactor core;

(b) an impeller within the pump casing;

(c) a pump coolant discharge and collector system comprising;

(i) an annular collector located radially outboard from said impeller, said annular collector having an entirely closed outer periphery for collecting fluid from the impeller and producing a uniform circumferential flow of the fluid;

(ii) turning means comprising a plurality of individual passageways located in an axial position relative to said annular collector for receiving cooling fluid from the annular collector and turning it into a substantially axial direction while maintaining a substantially constant average flow rate; and (d) a plurality of annular pump coolant diffuser vanes located between the impeller and the discharge and collector system.

* * * * *